US005874691A

United States Patent [19]

Manole et al.

[11] Patent Number: 5,874,691

[45] Date of Patent: Feb. 23, 1999

[54] KINETIC ENERGY COLLAPSIBLE TRAINING PROJECTILE

[75] Inventors: Leon Manole, Great Meadows; Stewart Gilman, Wharton; Paul Valenti, North Haledon, all of N.J.

[73] Assignee: The United States of America as represented by the Secretary of the Navy, Washington, D.C.

[21] Appl. No.: 975,439

[22] Filed: Nov. 21, 1997

[51] Int. Cl.[6] ..... F42B 8/12

[52] U.S. Cl. ..... 102/529; 102/507; 102/521

[58] Field of Search ..... 102/501, 502, 102/506–510, 517, 521, 523, 703, 395, 498, 529

[56] References Cited

U.S. PATENT DOCUMENTS

| | | | |
|---|---|---|---|
| 594,199 | 11/1897 | Field | 102/507 |
| 2,661,694 | 12/1953 | Allen et al. | 102/508 |
| 3,941,059 | 3/1976 | Cobb | 102/510 |
| 4,553,482 | 11/1985 | Weber et al. | 102/521 |
| 4,765,248 | 8/1988 | Kruse et al. | 102/529 |
| 4,776,279 | 10/1988 | Pejsa | 102/510 |
| 5,009,164 | 4/1991 | Grinberg | 102/529 |
| 5,501,155 | 3/1996 | Hollis et al. | 102/529 |
| 5,691,501 | 11/1997 | Gilbert | 102/529 |

FOREIGN PATENT DOCUMENTS

| | | | |
|---|---|---|---|
| 7915 | of 1893 | United Kingdom | 102/507 |

*Primary Examiner*—Harold J. Tudor
*Attorney, Agent, or Firm*—John F. Moran; Michael C. Sachs

[57] ABSTRACT

A collapsible training projectile includes a nose, a body and a tail. The body has a forwardmost end secured to the nose, and a rearwardmost end secured to the tail. The body further includes one or more axial, longitudinal slots that extend radially through at least part of the body, such that when the projectile impacts with an object, the kinetic energy causes the body to plastically deform along the slots, thereby reducing the penetration energy of the projectile. In another embodiment, the projectile includes a wedge, a body and a tail. The forwardmost end of the body is secured to the wedge, and its rearwardmost end is secured to the tail. The body includes an axial hole which is formed along the axial center of the body, and which extends from approximately the rearward tip of the wedge to the rearwardmost end of the body, such that when the projectile impacts with an object, the kinetic energy drives the rearward tip of the wedge partially through the axial hole, causing the forwardmost end of the body to plastically deform and to sheer around the wedge.

7 Claims, 4 Drawing Sheets

KINETIC ENERGY COLLAPSIBLE TRAINING PROJECTILE

The invention described herein may be manufactured and used by or for the Government of the United States for governmental purposes.

FIELD OF THE INVENTION

This invention relates generally to projectiles, and in particular to a collapsible training projectile with limited penetration capability.

BACKGROUND OF THE INVENTION

Kinetic energy training projectiles differ from service projectiles in that they are not designed for target penetration. Conventional training projectiles have the ability to penetrate the wall or armor of an object, causing fragments from the fracture and breakaway of the wall or armor to pose potential danger to persons in the vicinity.

Therefore, there is still a need for a training projectile with minimal penetration capability.

SUMMARY OF THE INVENTION

An object of the present invention is to provide a new kinetic energy collapsible training projectile with limited penetration capability, for minimizing accidental personal injury and unintended damage to property.

Another object of the present invention is to provide a new kinetic energy collapsible training projectile which can be manufactured using standard machining techniques.

A further object of the present invention is to provide a new kinetic energy collapsible training projectile that maintains predetermined static margin and aerodynamic design during flight.

The foregoing and additional features and advantages of the present invention are realized by a collapsible training projectile that includes a nose, a body and a tail. The body has a forwardmost end secured to the nose, and a rearwardmost end secured to the tail. The body further includes one or more axial, longitudinal slots that extend radially through at least part of the body, such that when the projectile impacts with an object, the kinetic energy causes the body to plastically deform along the slots, thereby reducing the penetration energy of the projectile.

In another embodiment, the projectile includes a wedge, a body and a tail. The forwardmost end of the body is secured to the wedge, and its rearwardmost end is secured to the tail. The body includes an axial hole which is formed along the axial center of the body, and which extends from (approximately the rearward tip of the wedge to the rearwardmost end of the body, such that when the projectile impacts with an object, the kinetic energy drives the rearward tip of the wedge partially through the axial hole, causing the forwardmost end of the body to plastically deform and to sheer around the wedge.

BRIEF DESCRIPTION OF THE DRAWING

The above and other features of the present invention and the manner of attaining them, will become apparent, and the invention itself will be best understood, by reference to the following description and the accompanying drawing, wherein.

Similar numerals refer to similar elements in the drawing. It should be understood that the sizes of the different components in the figures are not necessarily in exact proportion or to scale, and are shown for visual clarity and for the purpose of explanation.

DETAILED DESCRIPTION OF THE PREFERRED EMBODIMENT

Figure 1:
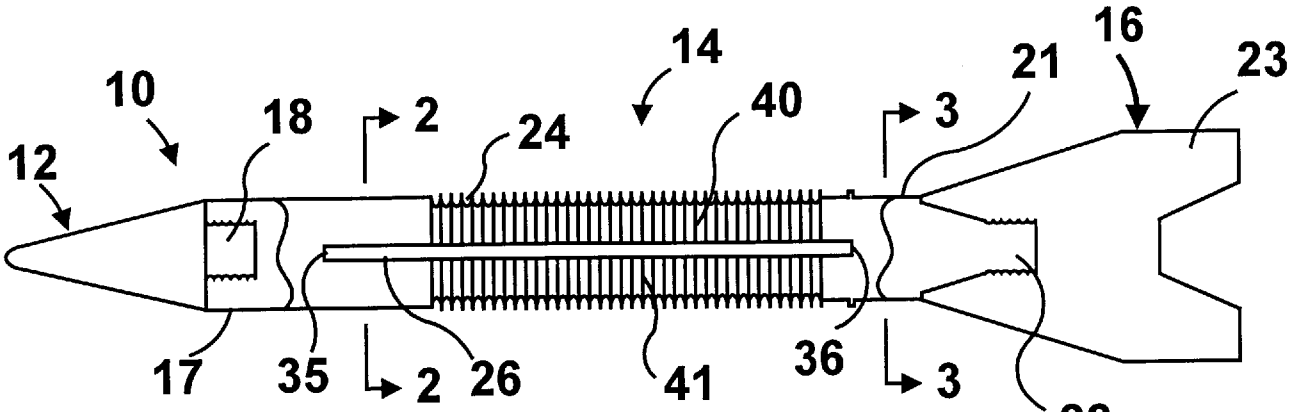
FIG. 1 is a partly cross-sectional side view of a training projectile according to the present invention.

FIG. 1 illustrates a collapsible training projectile 10 according to the present invention. The projectile 10 is formed of a windshield or nose 12, a body 14, and a tail 16. The nose 12 may be a conventional spine, ogive or rounded nose, and is secured to the forwardmost end 17 of the body 14 by means of a threaded member 18. The rearwardmost end 21 of the body 14 is secured to the tail 16 by a threaded member 22. The tail 16 is fitted with fins 23, and ensures that the projectile 10 spins when fired from a smooth bore or non-rifled system.

The body 14 is generally cylindrically shaped, and includes peripheral buttress grooves 24. The diameter of the body 14 is smaller than the inside diameter of the bore of tube from which the projectile is fired. An obturator and a sabot may be fastened about the body 14 to provide a friction fit between the bore of the cannon and the projectile 10, and to prevent forward thrust gasses from escaping from the bore prior to the escape of the projectile 10 when fired. The nose 12, the body 14 and the tail 16 have a common longitudinal axis.

Figure 2:
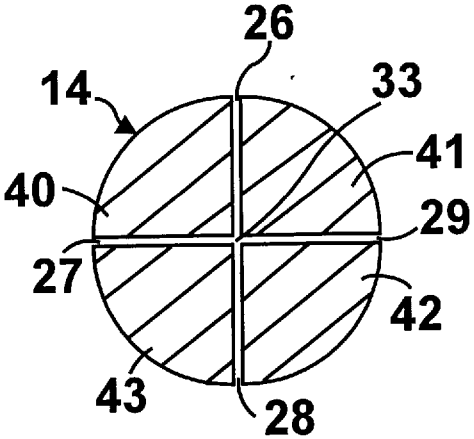
FIG. 2 is an enlarged sectional view of the training projectile of FIG. 1, taken along line 2—2.

As further illustrated in FIG. 2, the body 14 includes one or more axial, longitudinal slots, such as slots 26, 27, 28, 29. In this particular embodiment, the body 14 is shown to include four slots 26 through 29 that are normal to each other, and that extend radially through the body 14 for intersecting at the central axis of the projectile 10 and for defining an axial central channel or perforation 33. The perforation 33 extends along the central axis of the body 14, between a forward point 35 and a rearward point 36. The length of the perforation 33 is approximately two thirds of the total body axial length. It should be clear that in other embodiments, the slots 26 through 29 do not extend all the way through the body 14, and do not intersect. In particular embodiment, the body includes at least two or more axils, longitudinal slots.

Figure 3:
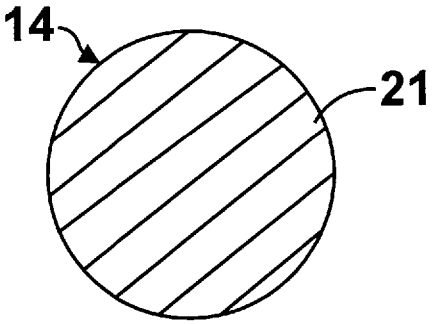
FIG. 3 is an enlarged sectional view of the training projectile of FIG. 1, taken along line 3—3.

In this example, the slots 26 through 29 partition part of the body 14 along which they extend, into four similar columns 40, 41, 42, 43 having quadrant-like cross-sectional areas. These columns 40 through 43 are secured together by the body forwardmost end 17 and the rearwardmost end 21, having a solid structure as illustrated in FIG. 3. The columns 40 through 43 extend between the forward point 35 and the rearward point 36 of the perforation 33.

The slots 26 through 29 are preferably identical and equally spaced and circumferentially positioned. They are milled in the body 14 using standard machining techniques. The thickness of the slots 26 through 29 may vary between approximately 0.5 mm and the radius of the body 14, and their length may range between approximately ¼ and ⅞ the length of the body 14. In addition, the number of slots is not limited to four as is illustrated in FIG. 2, and may vary between one and 6 or more slots. The nose 12 and the body 14 are made of a solid material such as steel.

Figure 4:
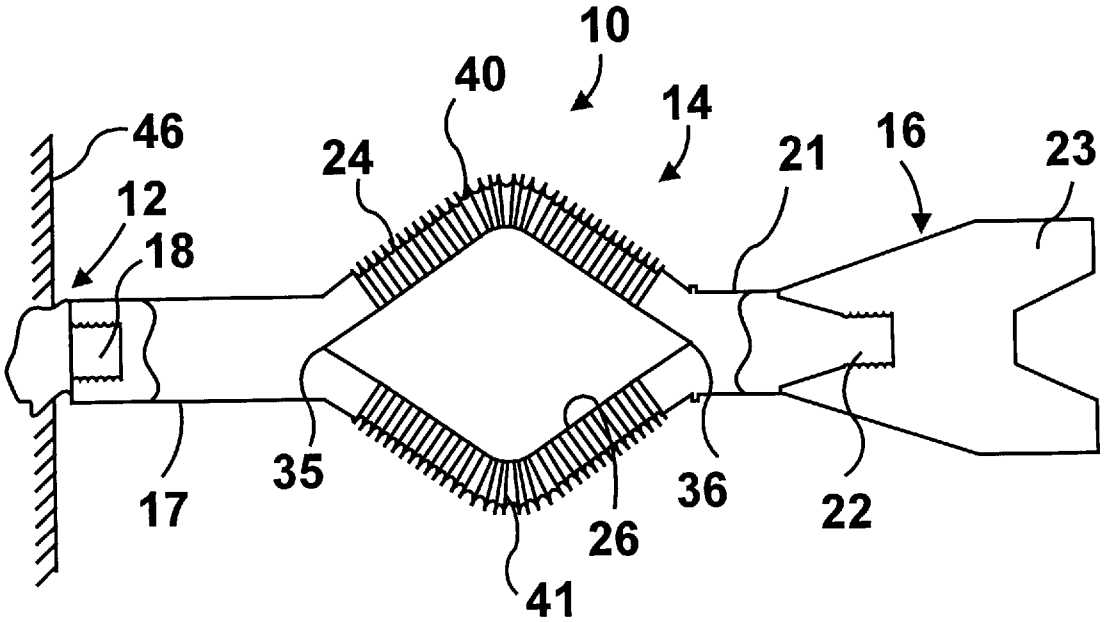
FIG. 4 is a side view of the training projectile of FIG. 1, illustrated after impact with an object.

In use, if the projectile 10 impacts with an object 46, the kinetic energy causes the body 14 to plastically deform along the milled slots 26 through 29, as illustrated in FIG. 4, and to absorb the kinetic energy, thereby reducing the penetration energy of the projectile 10. Upon impact, the columns 40 through 43 collapse and begin to crack or fragment, thus leading to a substantial increase in the cross sectional area of the body 14, which further limits the penetration of the projectile 10 through the object 46. As a result, potential personal injuries and damage to property in the vicinity of the impact site are minimized.

Figure 5:
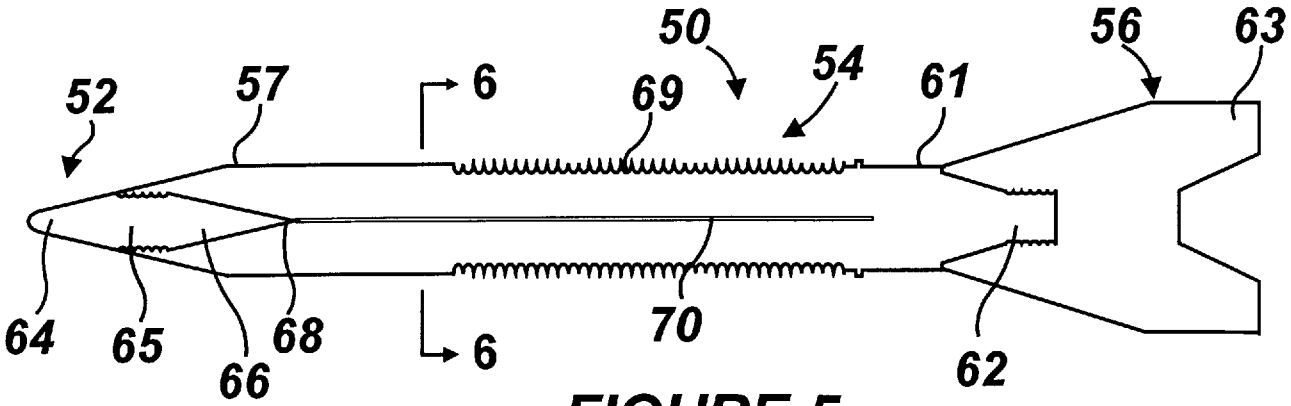
FIG. 5 is a sectional side view of another embodiment of the training projectile according to the present invention.

FIG. 5 illustrates another collapsible training projectile 50 according to the present invention. The projectile 50 is formed of a wedge 52, a body 54, and a tail 56. The wedge 52 is secured to the forwardmost end 57 of the body 54, and the rearwardmost end 61 of the body 54 is secured to the tail 56 by a threaded member 62. The tail 56 is fitted with fins 63, and ensures that the projectile 50 spins when fired from a smooth bore or non-rifled system.

Figure 7:
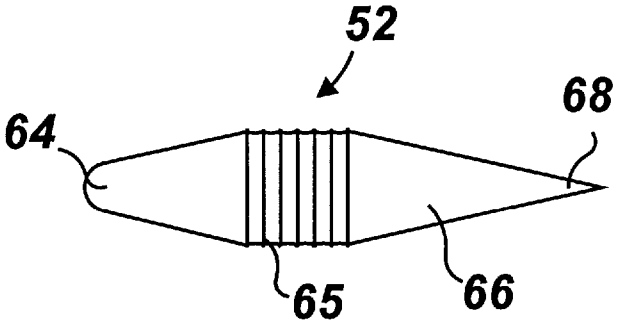
FIG. 7 is a side view of a wedge forming part of the training projectile of FIG. 5.

The wedge 52 is further shown in FIG. 7, and includes three sections 64, 65, 66. The first section 64 is generally pointed, spike, ogive or rounded, arid forms the nose or windshield of the projectile 50. The second section 65 is externally threaded and mates with a matching internally threaded section of the body 54, in order to secure the wedge 52 to the body 54. The third section 66 is conically shaped and defines a sharp tip 68 at its rear end.

Figure 6:
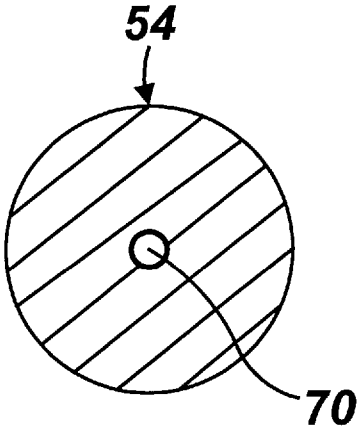
FIG. 6 is an enlarged sectional view of the training projectile of FIG. 5, taken along line 6—6.

The body 54 is generally cylindrically shaped, and includes peripheral buttress grooves 69. The body 54 further includes an axial hole or perforation 70 (FIG. 6) which is drilled along the axial center of the body 54; and which extends from approximately the tip 68 of the wedge 52 to almost the rearwardmost end 61 of the body 54. While the body 54 is shown to include a single axial hole 70, it should be understood that a pattern of parallel, longitudinal holes may be formed within the body 54. In one embodiment, the hole 70 has a circular cross section, and extends along approximately two thirds the axial length of the body 54. It should be clear that the hole 70 may alternatively have a different cross-section such as a square, rectangular, triangular, star, or any other appropriate shape.

Figure 8:
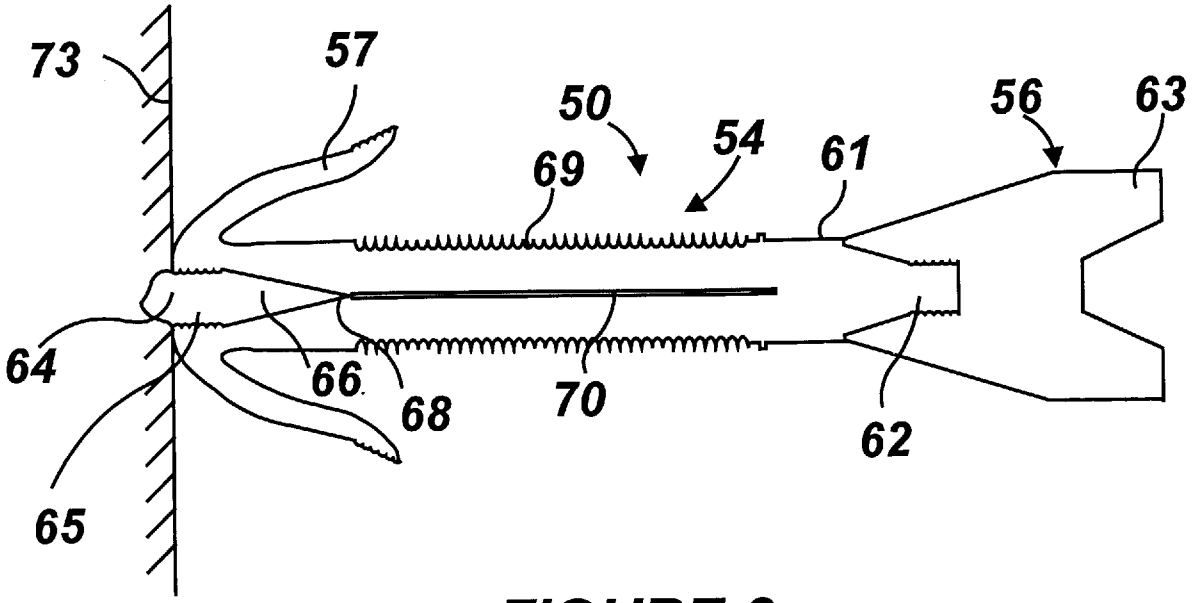
FIG. 8 is a side view of the training projectile of FIG. 6, illustrated after impact with an object.

In use, if the projectile 50 impacts with an object 73, the kinetic energy drives the tip 68 of the wedge 52 through the hole 70, causing the body forwardmost end 57 to sheer around the wedge 52 (see FIG. 8). The wedge action increases the cross sectional area of the projectile 50 during the plastic deformation of the body 54, thereby minimizing the penetration characteristics of the projectile 50. The wedge 52 is metallic, such as steel. The body 54 is composed of a material that is less tough and less ductile than the wedge 52, so as to permit the sheering action to occur.

It should be apparent that many modifications may be made to the invention without departing from the spirit and scope of the invention. Therefore, the drawings, and description relating to the use of the invention are presented only for the purposes of illustration and direction.

What is claimed is:

1. A collapsible training projectile comprising in combination:

a nose;

a body having a forewardmost end and a rearwardmost end, said forewardmost end being secured to said nose;

a tail including fins secured to said rearwardmost end of said body; and said body including at least two or more axial, longitudinal slots extending radially through at least part of said body, wherein said at least two or more slots extend through the outer surfaces of said body and along the length of said body and partition part of said body between a forward point located within said body and a rearward point located within said body, said partitioned body forming outwardly collapsible solid columns of said body, said at least two or more slots intersect at a central axis of said body;

such that when the projectile impacts with an object, the kinetic energy causes the formed collapsible columns of said body to outwardly collapse and plastically deform along said at least two or more slots at approximately mid-sections of said at least two or more slots, thereby reducing the penetration energy of the projectile and breakaway of the object.

2. The collapsible projectile according to claim 1, wherein two axial slots intersect at the central axis of said body.

3. The collapsible projectile according to claim 1, wherein the length of said at least two slots are approximately two thirds of the total body axial length.

4. The collapsible projectile according to claim 1, wherein four axial slots intersect at said central axis of said body.

5. The collapsible projectile according to claim 4, wherein said four axial slots form four columns having similar quadrant cross-sectional areas.

6. The collapsible projectile according to claim 1, wherein upon impact with the object, said formed columns collapse, leading to a substantial increase in the cross sectional area of said body, and limiting the penetration of the projectile through the object.

7. The collapsible projectile according to claim 1, wherein said body is generally cylindrically shaped, and includes peripheral buttress grooves.

* * * * *

UNITED STATES PATENT AND TRADEMARK OFFICE

CERTIFICATE OF CORRECTION

PATENT NO. : 5,874,691

DATED : February 23, 1999

INVENTOR(S) : L. Manole et al.

It is certified that error appears in the above-identified patent and that said Letters Patent is hereby corrected as shown below:

On title page, item [73] Assignee: ", in the third line thereof, the word "Navy" has been changed to read --Army--.

Signed and Sealed this

Seventh Day of September, 1999

*Attest:*

Q. TODD DICKINSON

*Attesting Officer*

*Acting Commissioner of Patents and Trademarks*